US008876541B1

(12) United States Patent
Wu

(10) Patent No.: US 8,876,541 B1
(45) Date of Patent: Nov. 4, 2014

(54) POWER PLUG

(71) Applicant: Well Shin Technnolgy Co., Ltd., Taipei (TW)

(72) Inventor: Jui Hsiung Wu, Taipei (TW)

(73) Assignee: Well Shin Technology Co., Ltd., Taipei (TW)

( * ) Notice: Subject to any disclaimer, the term of this patent is extended or adjusted under 35 U.S.C. 154(b) by 0 days.

(21) Appl. No.: 13/964,546

(22) Filed: Aug. 12, 2013

(51) Int. Cl.
*H01R 29/00* (2006.01)
*H01R 27/00* (2006.01)

(52) U.S. Cl.
CPC ..... *H01R 27/00* (2013.01)
USPC ..... 439/173

(58) Field of Classification Search
CPC ..... H01R 27/00; H01R 29/00; H01R 31/065; H01R 13/6675
USPC ..... 439/173–176
See application file for complete search history.

(56) References Cited

U.S. PATENT DOCUMENTS

| | | | | |
|---|---|---|---|---|
| 4,815,983 | A * | 3/1989 | Erickson et al. | 439/173 |
| 6,793,499 | B1 * | 9/2004 | Chen | 439/13 |
| 7,255,568 | B1 * | 8/2007 | Wu | 439/23 |
| 7,484,986 | B1 * | 2/2009 | Wu | 439/346 |
| 8,002,554 | B2 * | 8/2011 | Wadsworth | 439/18 |
| 8,033,847 | B1 * | 10/2011 | Chen | 439/172 |
| 8,079,877 | B1 * | 12/2011 | Lai et al. | 439/172 |
| 8,123,528 | B2 * | 2/2012 | Devlin et al. | 439/21 |
| 8,313,335 | B2 * | 11/2012 | Wu | 439/172 |
| 2008/0231234 | A1 * | 9/2008 | Mah | 320/138 |

* cited by examiner

*Primary Examiner* — Briggitte R Hammond
(74) *Attorney, Agent, or Firm* — WPAT, P.C.; Anthony King

(57) ABSTRACT

A power plug includes an insulating housing in which a receiving barrel is crossed, top and bottom covers covering top and bottom ends of the receiving barrel, a sliding strip slidably located between the top and bottom covers with serrated sliding teeth protruding on two opposite sides thereof, two rotating axles located at two sides of the sliding strip with rotating teeth protruding on two relative insides thereof and meshed with the sliding teeth, two plug pins vertically integrated in the rotating axles and a rotating ring sheathing outside the receiving barrel with two pushing blocks protruding at an inside wall thereof. The pushing blocks project into the receiving barrel and are against two ends of the sliding strip to push the sliding strip to slide by rotating the rotating ring so as to drive the rotating axles together with the plug pins to rotate relatively.

10 Claims, 7 Drawing Sheets

POWER PLUG

BACKGROUND OF THE INVENTION

1. Field of the Invention

The present invention relates to a plug, and more particularly to a power plug.

2. The Related Art

With the progress of society, various kinds of electrical equipments have become an indispensable tool in people's daily life. Power converter as an electrical equipment, such as adapter of notebook and chargers of mobile phone and digital camera, is more and more widely used. The main function of the power converter is to convert AC (Alternating Current) to DC (Direct Current) to be used in DC equipments.

The power converter electrically connects with a wall socket through a plug which is used to insert in the wall socket. However, the plug of the power converter generally only applies to a kind of wall socket. But the wall sockets in different countries often have different standards. In order to use the power converter in different countries, many different types of extra adapters matching with the different standards of the wall sockets respectively need be used to firstly insert the plug of the power converter in the adapters, and then the corresponding adapters are inserted in the wall sockets to realize electrical connection between the power converter and the different wall sockets. It is quite inconvenient for user.

SUMMARY OF THE INVENTION

Accordingly, an object of the present invention is to provide a power plug. The power plug includes an insulating housing, a top cover, a bottom cover, a pair of rotating axles, a pair of plug pins, a sliding strip and a rotating ring. The insulating housing has a top plate in which a receiving barrel is vertically crossed. A top edge of the receiving barrel protrudes upward to form a blocking wall. The top cover covers a top end of the receiving barrel of the insulating housing. A substantial middle of a bottom face of the top cover is concaved upward to form an elongated top fillister. The bottom cover covers a bottom end of the receiving barrel of the insulating housing. A substantial middle of a top face of the bottom cover protrudes upward to form a supporting wall. A top face of the supporting wall is concaved downward to form an elongated bottom fillister apart facing the top fillister. Top and bottom faces of the sliding strip protrude upward and downward to form a pair of guide rails. The guide rails are slidably inserted in the top fillister and the bottom fillister to make the sliding strip levelly slidable between the top cover and the bottom cover. Two opposite sides of the sliding strip oppositely protrude outward to form serrated sliding teeth. Each of the rotating axles has a rotating portion. The rotating portions are rotatably restrained between the top cover and the bottom cover and located at two sides of the sliding strip. Relative insides of the rotating portions protrude face-to-face to form rotating teeth meshed with the sliding teeth of the sliding strip. The plug pins are vertically integrated in the rotating axles respectively and project outward through the top cover. The rotating ring rotatably sheathes outside the receiving barrel and is located above the top plate of the insulating housing. An inside wall of the rotating ring protrudes inward to form a pair of pushing blocks projecting into the receiving barrel and located at two ends of the blocking wall. Two sidewalls of the pushing blocks away from the two ends of the blocking wall are designed as arc shape and designated as pushing sidewalls. The pushing sidewalls can be against two ends of the sliding strip to push the sliding strip to slide forward and rearward in the process of rotating the rotating ring clockwise and counterclockwise until the pushing blocks are blocked by the blocking wall. The slide of the sliding strip drives the rotating axles to rotate and further drives the plug pins to rotate to an eight-shape state and a parallel state.

As described above, the power plug of the embodiment of the present invention can conveniently realize a convert between standard of America and standard of Australia by rotating the rotating ring to push the sliding strip to slide and then drive the rotating axles and the plug pins to rotate relatively.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
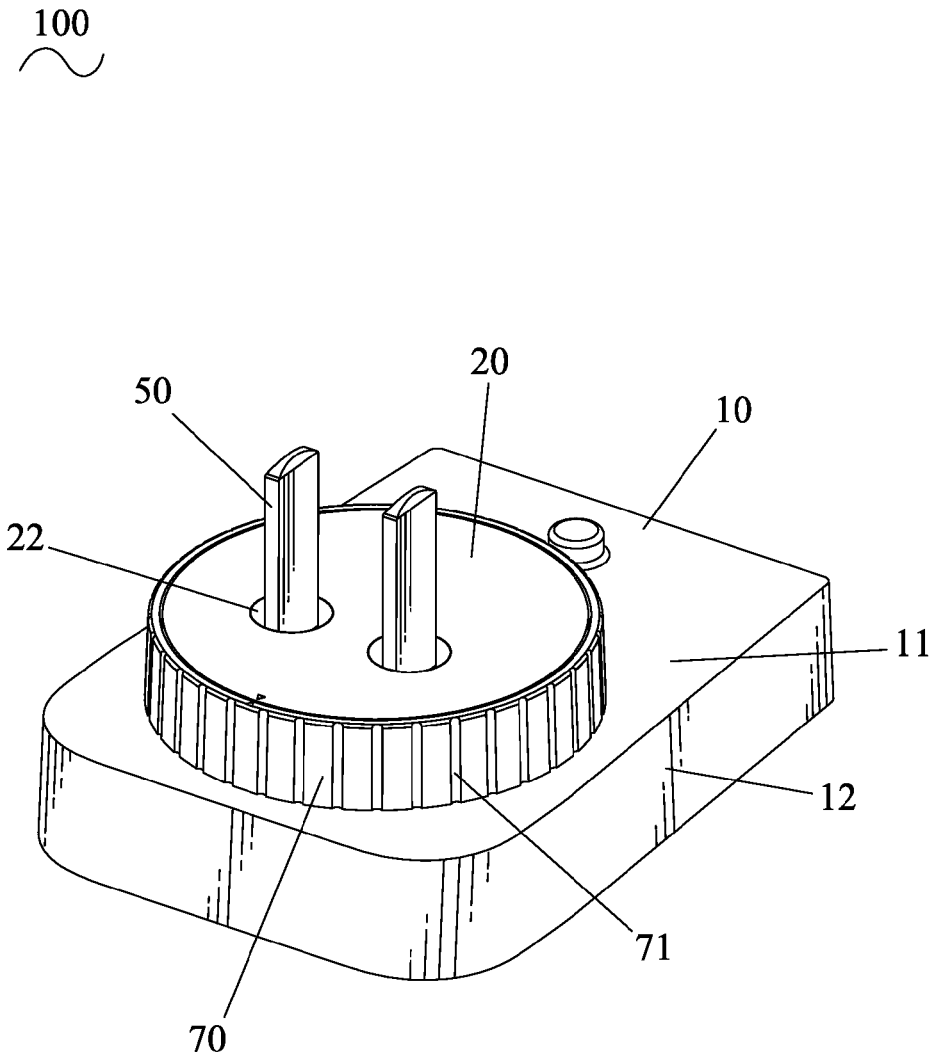
FIG. 1 is an assembled, perspective view of a power plug in accordance with an embodiment of the present invention.
Figure 2:
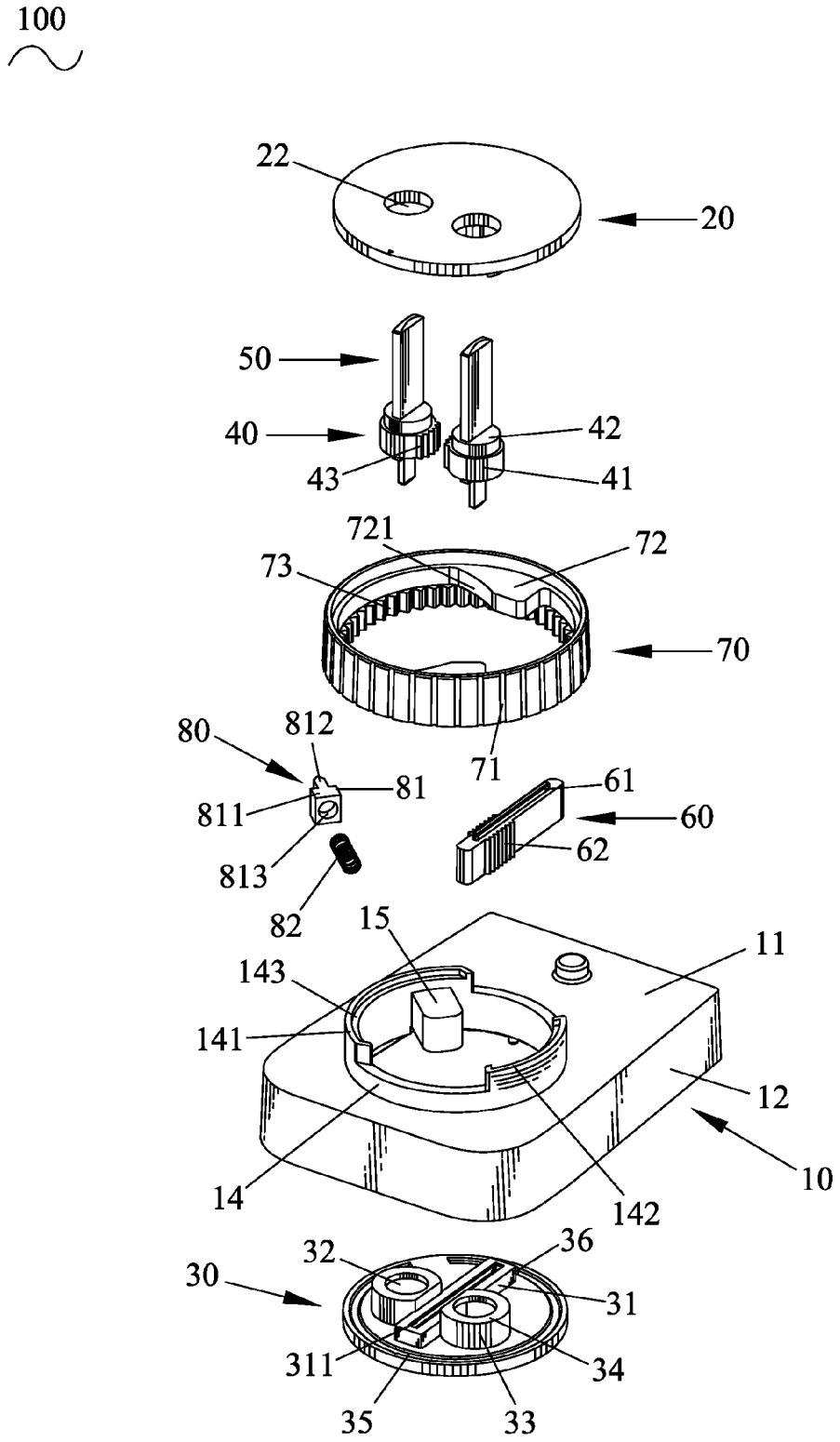
FIG. 2 is an exploded, perspective view of the power plug shown in FIG. 1.
Figure 3:
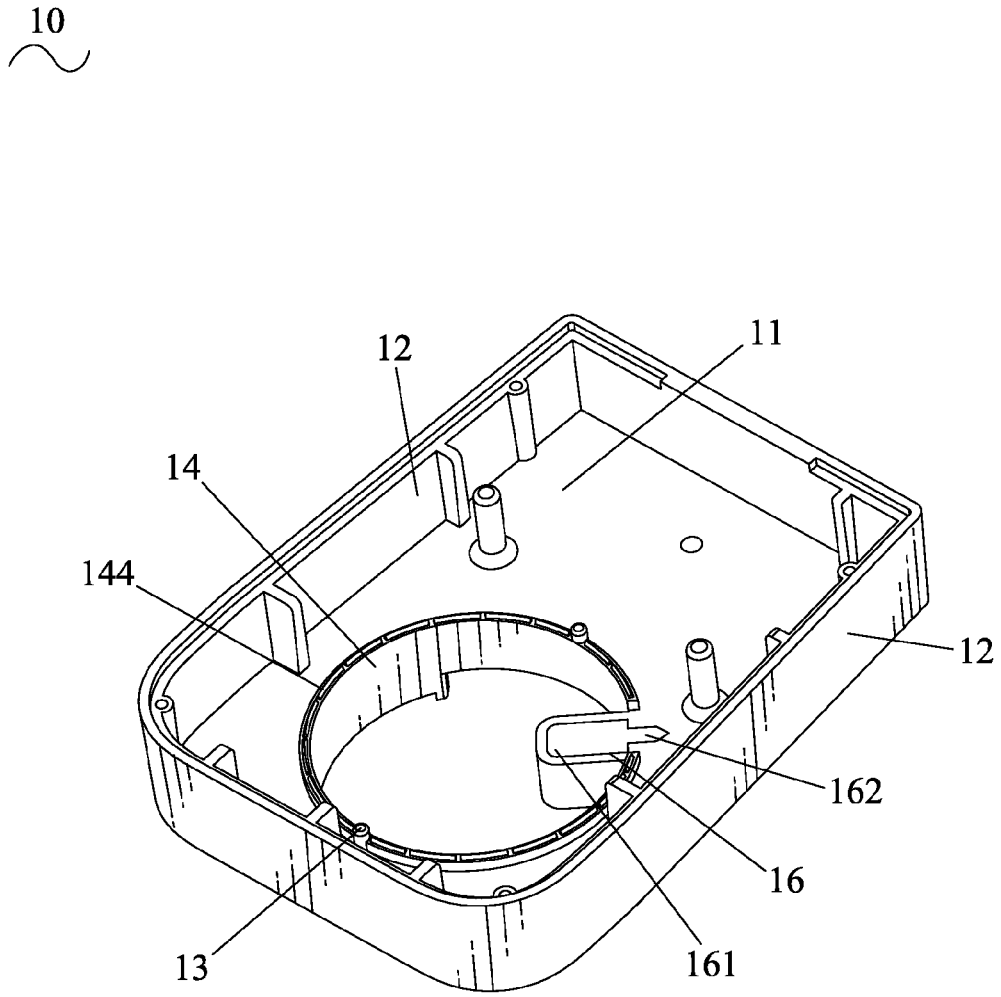
FIG. 3 is a perspective view of an insulating housing of the power plug shown in FIG. 1.
Figure 4:
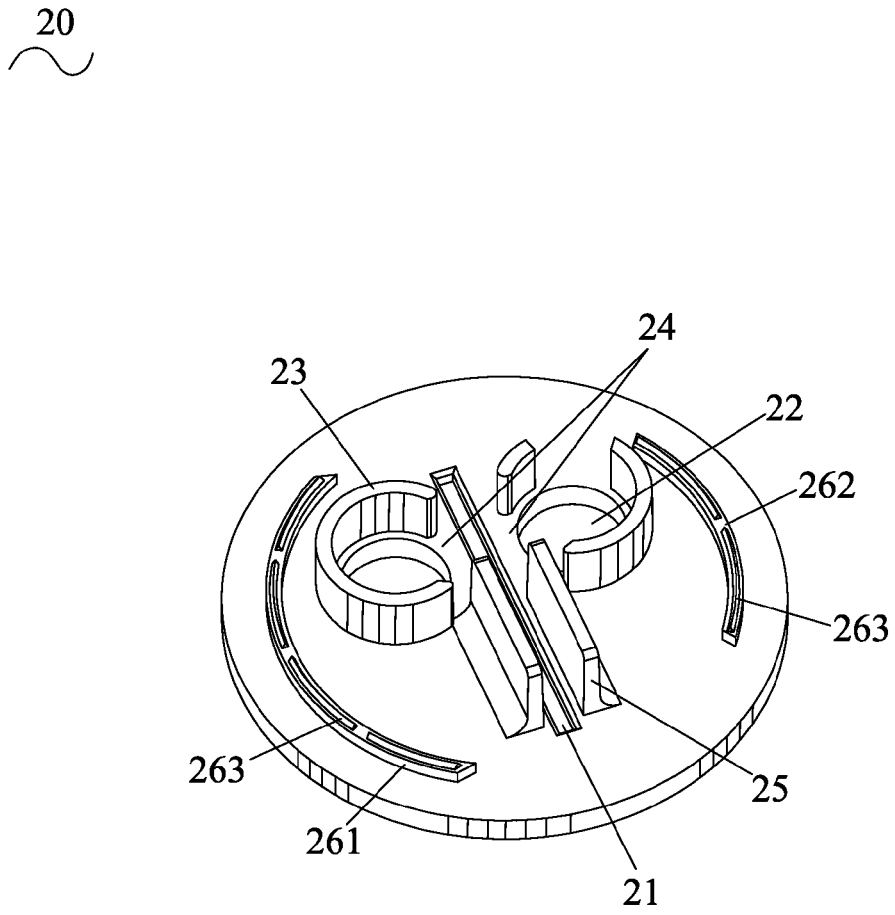
FIG. 4 is a perspective view of a top cover of the power plug shown in FIG. 1.
Figure 5:
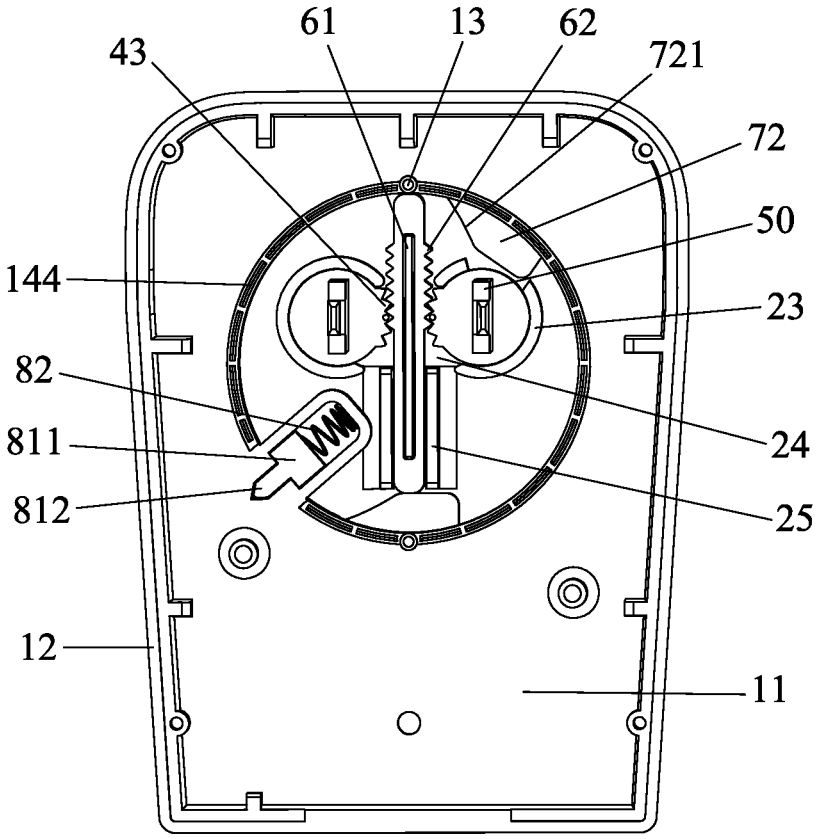
FIG. 5 is an upward view of the power plug of FIG. 1, wherein a bottom cover is removed from the power plug.

Referring to the drawings in greater detail, and first to FIG. 1 and FIG. 2, an embodiment of the present invention is embodied in a power plug 100. The power plug 100 includes an insulating housing 10, a top cover 20, a bottom cover 30, a pair of rotating axles 40, a pair of plug pins 50, a sliding strip 60, a rotating ring 70 and a braking apparatus 80.

With reference to FIGS. 2 to 5, the insulating housing 10 has a rectangle top plate 11 in which a receiving barrel 14 is vertically crossed, and a plurality of side plates 12 protruded downward from the edges of the top plate 11 and connected with one another. A pair of positioning pillars 13 is protruded downward at a bottom face of the top plate 11 and connects with the receiving barrel 14. A top edge of the receiving barrel 14 protrudes upward to form a blocking wall 142 and a fastening wall 141 apart from the blocking wall 142. The top faces of the fastening wall 141 and the blocking wall 142 each is concaved downward to form a fastening fillister 143. A bottom edge of the receiving barrel 14 protrudes downward to form a plurality of fixing wedges 144. An inside wall of the receiving barrel 14 protrudes inward to form a locating block 15. A bottom face of the locating block 15 is concaved upward to form a receiving groove 16 further spread outward to the top plate 11. The receiving groove 16 includes a locating groove 161 opened in the locating block 15 and a sliding slot 162 penetrating outward through the receiving barrel 14 to extend in the top plate 11. The sliding slot 162 further vertically penetrates through the top plate 11 to be exposed outward.

The top cover 20 covers a top end of the receiving barrel 14 of the insulating housing 10. A substantial middle of a bottom face of the top cover 20 is concaved upward to form an elongated top fillister 21. The top cover 20 defines a pair of fixing holes 22 located at two sides of the top fillister 21. A periphery of each fixing hole 22 protrudes downward to form a fixing barrel 23 of which a gap 24 is opened at a part near to the top fillister 21. The bottom face of the top cover 20 protrudes downward to form a pair of blocking plates 25 located at two sides of the top fillister 21 to restrain the sliding strip 60 therebetween. The bottom face of the top cover 20 further protrudes downward to form a first locking wall 261 and a second locking wall 262 near to the periphery edge of the top cover 20 and corresponding to the fastening wall 141 and the blocking wall 142 of the insulating housing 10. The bottom faces of the first locking wall 261 and the second locking wall 262 further protrude downward to form a plurality of projections 263. The first locking wall 261 and the second locking wall 262 are buckled in the fastening fillisters 143 of the fastening wall 141 and the blocking wall 142 and the projections 263 are butted fusion with bottom walls of the fastening fillisters 143 by ultrasound technology.

The bottom cover 30 covers a bottom end of the receiving barrel 14 of the insulating housing 10. A substantial middle of a top face of the bottom cover 30 protrudes upward to form a supporting wall 31. A top face of the supporting wall 31 is concaved downward to form an elongated bottom fillister 311 apart facing the top fillister 21. The bottom cover 30 defines a pair of through holes 32 located at two sides of the supporting wall 31. A periphery of each through hole 32 protrudes upward to form an accepting barrel 33 of which a top edge extends inward to form a platform 34. A substantial periphery of the top face of the bottom cover 30 is concaved downward to form a fastening groove 35 corresponding to the bottom edge of the receiving barrel 14. The fastening groove 35 is closed at the position corresponding to the locating block 15. A pair of positioning holes 36 corresponding to the positioning pillars 13 of the insulating housing 10 is opened in the fastening groove 35 of the bottom cover 30. The positioning pillars 13 of the insulating housing 10 are inserted in the positioning holes 36 of the bottom cover 30. A bottom end of the receiving barrel 14 is embedded in the fastening groove 35 of the bottom cover 30. The fixing wedges 144 of the receiving barrel 14 of the insulating housing 10 are butted fusion with a bottom wall of the fastening groove 35 by ultrasound technology.

Top and bottom faces of the sliding strip 60 protrude upward and downward to form a pair of guide rails 61. The guide rails 61 are slidably inserted in the top fillister 21 and the bottom fillister 311 to make the sliding strip 60 levelly slidable between the top cover 20 and the bottom cover 30. Two opposite sides of the sliding strip 60 oppositely protrude outward to form serrated sliding teeth 62.

The rotating axles 40 each has a rotating portion 41. The rotating portions 41 are rotatably restrained between the top cover 20 and the bottom cover 30 and located at two sides of the sliding strip 60. A top of the rotating portion 41 protrudes upward to form a fastening portion 42 which is smaller than the rotating portion 41 in diameter and inserted in the fixing hole 22. The rotating portion 41 of the rotating axle 40 is held in the fixing barrel 23 and propped on the platform 34. Relative insides of the rotating portions 41 protrude face-to-face to form rotating teeth 43 projecting outward through the gaps 24 of the corresponding fixing barrels 23 to be meshed with the sliding teeth 62 of the sliding strip 60.

The plug pins 50 are vertically integrated in the rotating axles 40 respectively and project outward through the fixing holes 22 of the top cover 20. Bottom ends of the plug pins 50 stretch in the accepting barrels 33 of the bottom cover 30 respectively.

The rotating ring 70 rotatably sheathes outside the receiving barrel 14 and is located above the top plate 11 of the insulating housing 10. A plurality of slots 71 are concaved inward in an outside periphery of the rotating ring 70 and arranged at regular intervals along the periphery of the rotating ring 70. Each slot 71 penetrates vertically through the outside periphery of the rotating ring 70 in generatrix direction. An inside wall of the rotating ring 70 protrudes inward to form a pair of pushing blocks 72 projecting into the receiving barrel 14 and located at two ends of the blocking wall 142. In this embodiment, the pushing blocks 72 of the rotating ring 70 are movably located between the blocking wall 142 and the fastening wall 141 respectively. Two sidewalls of the pushing blocks 72 away from the two ends of the blocking wall 142 are designed as arc shape and designated as pushing sidewalls 721. The inside wall of the rotating ring 70 further protrudes inward to form braking teeth 73 arranged round the inner periphery of the rotating ring 70 and located under the pushing blocks 72.

The braking apparatus 80 is assembled in the receiving groove 16 of the locating block 15 of the insulating housing 10. The braking apparatus 80 includes a braking block 81 and a spring 82. The braking block 81 has a locating portion 811 slidably located in the locating groove 161 and a braking portion 812 extending outward from one side of the locating portion 811 to be slidably inserted in the sliding slot 162. The spring 82 is flexibly clamped between the locating portion 811 and an inside wall of the locating groove 161 and located opposite to the braking portion 812. The braking portion 812 further projects beyond a top face of the top plate 11 to engage with the braking teeth 73 of the rotating ring 70. Another side of the locating portion 811 of the braking block 81 opposite to the braking portion 812 defines a positioning groove 813. One end of the spring 32 is positioned in the positioning groove 813.

Figure 6:
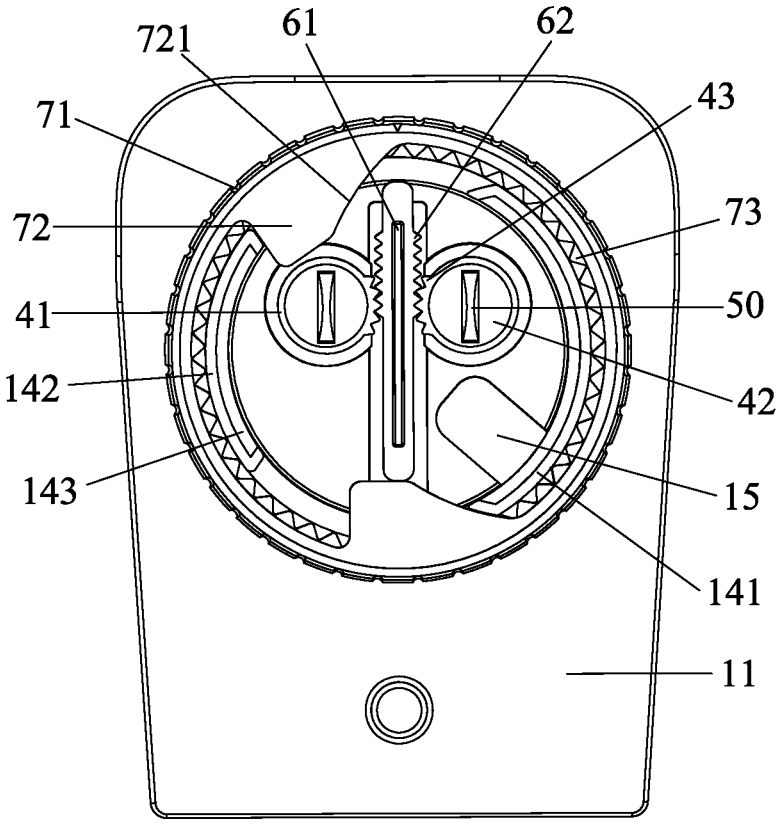
FIG. 6 and FIG. 7 show plug pins of the power plug are at two kinds of working states.
Figure 7:
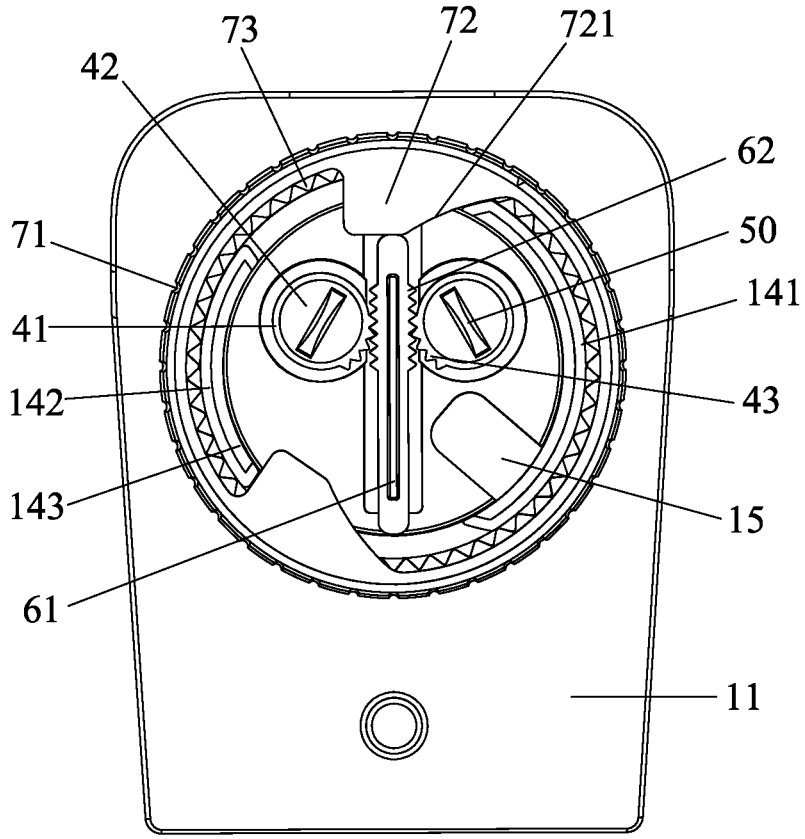

Referring to FIG. 6 and FIG. 7, in use, the pushing sidewalls 721 of the pushing blocks 72 of the rotating ring 70 can be against two ends of the sliding strip 60 to push the sliding strip 60 to slide forward and rearward in the process of rotating the rotating ring 70 clockwise and counterclockwise until the pushing blocks 72 are blocked by the blocking wall 142. The slide of the sliding strip 60 drives the rotating axles 40 to rotate and further drives the plug pins 50 to rotate to an eight-shape state and a parallel state.

In detail, when the rotating ring 70 is rotated clockwise, the pushing sidewall 721 of one pushing block 72 is against a rear end of the sliding strip 60 to push the sliding strip 60 to slide forward. The slide of the sliding strip 60 drives the rotating axles 40 to relatively rotate outward by virtue of the engagement of the sliding teeth 62 and the rotating teeth 43. The rotation of the rotating axles 40 further drives the plug pins 50 to relatively rotate outward to gradually show the eight-shape. Until the other pushing block 72 resists against the blocking wall 142, the rotating ring 70 stops rotating. At this time, the plug pins 50 are at the eight-shape state. The braking portion 812 of the braking block 81 is meshed in the braking teeth 73 to avoid the rotating ring 70 automatically rotating so as to keep the eight-shape state steady.

In the same way, when the rotating ring 70 is rotated counterclockwise, the pushing sidewall 721 of the other pushing block 72 is against a front end of the sliding strip 60 to push the sliding strip 60 to slide rearward. The slide of the sliding strip 60 drives the rotating axles 40 to relatively rotate inward by virtue of the engagement of the sliding teeth 62 and the rotating teeth 43. The rotation of the rotating axles 40 further drives the plug pins 50 to relatively rotate inward to gradually become parallel. Until one pushing block 72 resists against the blocking wall 142, the rotating ring 70 stops rotating. At this time, the plug pins 50 are at the parallel state. The braking portion 812 of the braking block 81 is meshed in the braking teeth 73 to avoid the rotating ring 70 automatically rotating so as to keep the parallel state steady.

As described above, the power plug 100 of the embodiment of the present invention can conveniently realize a convert between standard of America and standard of Australia by rotating the rotating ring 70 to push the sliding strip 60 to slide and then drive the rotating axles 40 and the plug pins 50 to rotate relatively.

What is claimed is:

1. A power plug, comprising:

an insulating housing having a top plate in which a receiving barrel is vertically crossed, a top edge of the receiving barrel protruding upward to form a blocking wall;

a top cover covering a top end of the receiving barrel of the insulating housing, a substantial middle of a bottom face of the top cover being concaved upward to form an elongated top fillister;

a bottom cover covering a bottom end of the receiving barrel of the insulating housing, a substantial middle of a top face of the bottom cover protruding upward to form a supporting wall, a top face of the supporting wall being concaved downward to form an elongated bottom fillister apart facing the top fillister;

a sliding strip of which top and bottom faces protrude upward and downward to form a pair of guide rails, the guide rails being slidably inserted in the top fillister and the bottom fillister to make the sliding strip levelly slidable between the top cover and the bottom cover, two opposite sides of the sliding strip oppositely protruding outward to form serrated sliding teeth;

a pair of rotating axles each having a rotating portion, the rotating portions being rotatably restrained between the top cover and the bottom cover and located at two sides of the sliding strip, relative insides of the rotating portions protruding face-to-face to form rotating teeth meshed with the sliding teeth of the sliding strip;

a pair of plug pins vertically integrated in the rotating axles respectively and projecting outward through the top cover; and a rotating ring rotatably sheathing outside the receiving barrel and located above the top plate of the insulating housing, an inside wall of the rotating ring protruding inward to form a pair of pushing blocks projecting into the receiving barrel and located at two ends of the blocking wall, two sidewalls of the pushing blocks away from the two ends of the blocking wall being designed as arc shape and designated as pushing sidewalls;

wherein the pushing sidewalls can be against two ends of the sliding strip to push the sliding strip to slide forward and rearward in the process of rotating the rotating ring clockwise and counterclockwise until the pushing blocks are blocked by the blocking wall, the slide of the sliding strip drives the rotating axles to rotate and further drives the plug pins to rotate to an eight-shape state and a parallel state.

2. The power plug as claimed in claim 1, wherein the top cover defines a pair of fixing holes located at two sides of the top fillister, a periphery of each fixing hole protrudes downward to form a fixing barrel of which a gap is opened at a part near to the top fillister, the bottom cover defines a pair of through holes located at two sides of the supporting wall, a periphery of each through hole protrudes upward to form an accepting barrel of which a top edge extends inward to form a platform, a top of the rotating portion protrudes upward to form a fastening portion which is smaller than the rotating portion in diameter and inserted in the fixing hole, the rotating portion of the rotating axle is held in the fixing barrel and propped on the platform with a bottom end of the plug pin stretching in the accepting barrel, the rotating teeth project outward through the gap of the fixing barrel.

3. The power plug as claimed in claim 2, wherein the bottom face of the top cover protrudes downward to form a pair of blocking plates located at two sides of the top fillister to restrain the sliding strip therebetween.

4. The power plug as claimed in claim 1, wherein the inside wall of the receiving barrel protrudes inward to form a locating block, a bottom face of the locating block is concaved upward to form a receiving groove further spread outward to the top plate, the receiving groove includes a locating groove opened in the locating block and a sliding slot penetrating outward through the receiving barrel to extend in the top plate, the sliding slot further vertically penetrates through the top plate to be exposed outward, the inside wall of the rotating ring protrudes inward to form braking teeth arranged round the inner periphery of the rotating ring and located under the pushing blocks, the power plug further includes a braking apparatus assembled in the receiving groove, the braking apparatus includes a braking block and a spring, the braking block has a locating portion slidably located in the locating groove and a braking portion extending outward from one side of the locating portion to be slidably inserted in the sliding slot, the spring is flexibly clamped between the locating portion and an inside wall of the locating groove and located opposite to the braking portion, the braking portion further projects beyond a top face of the top plate to engage with the braking teeth of the rotating ring.

5. The power plug as claimed in claim 4, wherein another side of the locating portion of the braking block opposite to the braking portion defines a positioning groove, one end of the spring is positioned in the positioning groove.

6. The power plug as claimed in claim 4, wherein a bottom edge of the receiving barrel protrudes downward to form a plurality of fixing wedges, a substantial periphery of the top face of the bottom cover is concaved downward to form a fastening groove corresponding to the bottom edge of the receiving barrel, a bottom end of the receiving barrel is embedded in the fastening groove of the bottom cover and the fixing wedges are butted fusion with a bottom wall of the fastening groove by ultrasound technology.

7. The power plug as claimed in claim 6, wherein the fastening groove is closed at the position corresponding to the locating block.

8. The power plug as claimed in claim 6, wherein a pair of positioning pillars is protruded downward at a bottom face of the top plate and connecting with the receiving barrel, a pair of positioning holes corresponding to the positioning pillars of the insulating housing is opened in the fastening groove of the bottom cover, the positioning pillars of the insulating housing are inserted in the positioning holes of the bottom cover.

9. The power plug as claimed in claim 1, wherein the top edge of the receiving barrel further protrudes upward to form a fastening wall apart from the blocking wall, the pushing blocks of the rotating ring are movably located between the blocking wall and the fastening wall respectively, top faces of the fastening wall and the blocking wall each is concaved downward to form a fastening fillister, the bottom face of the top cover protrudes downward to form a first locking wall and a second locking wall near to the periphery edge of the top cover and corresponding to the fastening wall and the blocking wall of the insulating housing, bottom faces of the first and second locking walls further protrude downward to form a plurality of projections, the first and second locking walls are buckled in the fastening fillisters of the fastening wall and the blocking wall and the projections are butted fusion with bottom walls of the fastening fillisters by ultrasound technology.

10. The power plug as claimed in claim 1, wherein a plurality of slots is concaved inward in an outside periphery of the rotating ring and arranged at regular intervals along the periphery of the rotating ring, each slot penetrates vertically through the outside periphery of the rotating ring in generatrix direction.

* * * * *